United States Patent [19]

Dunbar et al.

[11] Patent Number: 4,988,884

[45] Date of Patent: Jan. 29, 1991

[54] HIGH TEMPERATURE RESISTANT FLAME DETECTOR

[75] Inventors: Robert A. Dunbar, Swampscott; John M. McClelland, South Weymouth, both of Mass.

[73] Assignee: Walter Kidde Aerospace, Inc., Wilson, N.C.

[21] Appl. No.: 275,119

[22] Filed: Nov. 22, 1988

[51] Int. Cl.[5] ..... G08B 17/12

[52] U.S. Cl. ..... 250/554; 250/239; 250/338.3; 340/578

[58] Field of Search ..... 250/554, 239, 338.3; 109/82; 169/48, 60, 61; 328/6; 340/577, 578; 431/78, 79

[56] References Cited

U.S. PATENT DOCUMENTS

| | | | |
|---|---|---|---|
| 1,988,858 | 1/1935 | Quereau . | |
| 2,834,008 | 5/1958 | Carbauh | 340/578 |
| 3,775,762 | 11/1973 | Trumble . | |
| 3,967,255 | 6/1976 | Oliver et al. | 250/554 |
| 4,215,168 | 7/1980 | Yonemura et al. . | |
| 4,280,058 | 7/1981 | Tar | 250/554 |
| 4,381,716 | 5/1983 | Hastings et al. | 109/82 |
| 4,529,881 | 7/1985 | Ceurvels et al. | 250/353 |
| 4,533,834 | 8/1985 | McCormack | 250/554 |
| 4,547,673 | 10/1985 | Larsen et al. | 250/554 |
| 4,553,031 | 11/1985 | Cholin et al. | 340/578 |
| 4,597,451 | 7/1986 | Moore et al. | 169/61 |
| 4,639,605 | 1/1987 | Seki et al. | 250/554 |
| 4,691,196 | 9/1987 | Kern et al. | 340/578 |
| 4,706,760 | 11/1987 | Arai et al. | 169/61 |
| 4,742,236 | 5/1988 | Kawakami et al. | 250/554 |
| 4,750,142 | 6/1988 | Akiba et al. | 169/61 |
| 4,755,687 | 7/1988 | Akiba et al. | 250/554 |
| 4,775,347 | 10/1988 | Takada et al. . | |
| 4,815,199 | 3/1989 | Jenner et al. | 250/338.3 |
| 4,820,931 | 4/1989 | Dunbar | 250/554 |

FOREIGN PATENT DOCUMENTS

| | | |
|---|---|---|
| 4328918 | 7/1966 | Japan . |
| 4411220 | 7/1966 | Japan . |
| 2020870 | 11/1979 | United Kingdom . |
| 2097120 | 10/1982 | United Kingdom . |
| 2115143 | 9/1983 | United Kingdom . |
| 2174002 | 10/1986 | United Kingdom . |
| 2188725 | 10/1987 | United Kingdom . |

*Primary Examiner*—Edward P. Westin

*Attorney, Agent, or Firm*—Fish & Richardson

[57] ABSTRACT

A flame detector that comprises a housing adapted to contain a flame sensor and circuitry for processing signals produced by the sensor; the housing has a predetermined outer diameter, and a thin, highly thermally reflective coating is adhered to an outer surface of the housing to shield the sensor and circuitry from high ambient temperatures, whereby the detector is operable at the high ambient temperatures while having an outer diameter that is substantially the same as the predetermined diameter. A flame that has a predetermined flicker rate range is detected by detecting radiation within a compartment with a sensor, determining whether the detected radiation has an intensity which exceeds a predetermined threshold intensity, determining whether the detected radiation that exceeds the threshold has a flicker rate that is within the predetermined range, and determining whether a predetermined number of flickers that occur at a rate within the range have been detected within a variable time interval, and, if so, indicating that a flame is present within said compartment, the variable time interval starting upon detection of an initial flicker and ending after a predetermined delay unless a subsequent flicker is detected during said delay, a subsequent flicker detected during said delay extending the variable time interval for a predetermined time period such as that of the predetermined delay.

42 Claims, 4 Drawing Sheets

HIGH TEMPERATURE RESISTANT FLAME DETECTOR

BACKGROUND OF THE INVENTION

This invention relates to the detection of flames with flame detectors that are sufficiently rugged to withstand extremely high temperatures, and yet sufficiently small in size to allow mounting in small areas (such as in aircraft compartments or engine nacelles).

Aircraft fires, if undetected and not suppressed, can cause catastrophic consequences. It is therefore extremely desirable to accurately detect fires that occur in, e.g., engine nacelles and storage compartments, and quickly suppress the flames. A detector should be sufficiently rugged to remain operational for some time even in the presence of extreme temperatures, so that as the crew takes steps to suppress a detected fire (e.g., by releasing chemical suppressants) the detector can continue to provide reliable information about the state of the fire so that the crew can make an informed decision as to whether to take more severe action (such as landing the aircraft immediately). In fact, one military specification requires aircraft flame detectors to remain functional when exposed to a temperature of 2000° F. for 60 seconds. That same specification, however, as well as many other applications, requires the detector be sufficiently compact to be mounted within small, narrow spaces.

Many known detectors are housed in an anodized aluminum shell that has an outer diameter chosen to meet the size specifications. Encased within the housing is a flame sensor (e.g., a thermopile, pyroelectric, or photoresistive sensor) and a circuit card containing the detector electronics. To protect these components from shock and vibration, the remainder of the cavity is typically filled with a mechanically damping potting compound.

To increase tolerance to high temperatures, some detectors enclose the detector housing within a layer of thermally insulating potting material, which is itself surrounded by an additional outer shell (typically made from steel with a tin-plated outer surface). The added volume of material provides thermal insulation for the detector components mounted within the housing, but at the expense of increasing the size (i.e., the outer diameter) of the detector assembly.

To avoid needlessly expending chemical suppressants or unnecessarily landing and evacuating the aircraft, false alarms must be prevented. For example, the detector must distinguish between flames generated by chemicals such as hydrocarbons (to which a response is desired) and other sources of heat and light, such as ordinary sparking, sunlight, lightning, and fluorescent lighting. Additionally, it is desirable that the detector differentiates between brief flashes of hydrocarbon flames and sustained flames to which a response must be made.

SUMMARY OF THE INVENTION

One general aspect of the invention is a flame detector that comprises a housing adapted to contain a flame sensor and circuitry for processing signals produced by the sensor; the housing has a predetermined outer diameter, and a thin, highly thermally reflective coating is adhered to an outer surface of the housing to shield the sensor and circuitry from high ambient temperatures, whereby the detector is operable at the high ambient temperatures while having an outer diameter that is substantially the same as the predetermined diameter.

As a result, the detector can be used in applications (such as detecting flames in aircraft engine nacelles or storage compartments) that require the detector to be both small in size and highly resistant to temperature. Such high temperature tolerance permits the detector to continue to operate even when immersed in flame for a period of time, and thus provide the aircraft crew with continued information about the state of the fire. This allows the crew to make an informed judgment as to whether efforts at extinguishing the flames (e.g., with chemical suppressants) have been successful before taking other measures (e.g., immediately landing and evacuating the aircraft).

Preferred embodiments include the following features.

The thickness of the coating is such as to increase the predetermined diameter by less than 0.3 percent. A thermally insulating material is disposed within the housing and surrounds the circuitry to further protect the circuitry from the high ambient temperatures (e.g., 2000° F.). Thus, two levels of thermal protection are provided: a thermally reflective outer layer and an internal thermal barrier region between the circuitry and the housing.

A region of the housing supports a window (e.g., a sapphire window) for admitting radiation for detection by the sensor, and the coating exposes the window. An intermediate coating is disposed between the outer surface and the highly reflective coating in the region of the window to aid in adhering the window to the housing. Preferably, the housing comprises aluminum, the intermediate coating is copper, and the highly reflective coating is polished chromium. .

The electronics are disposed on a circuit card. Electrical connections between components of the circuitry are made with high-temperature-resistant solder, and the circuit card comprises a high-temperature-resistant material (such as G-30 material), thereby further increasing the tolerance of the circuitry to high ambient temperatures.

A second aspect of the invention provides a method of fabricating the flame detector housing by applying a thin layer of material to an outer surface of the housing, and making the layer highly thermally reflective to shield the sensor and the electronic circuitry from high ambient temperatures.

Preferred embodiments include the following features.

A thermally insulating material is disposed in the housing surrounding the circuitry to further protect the circuitry from the high ambient temperatures. The layer of material is preferably applied in at least two steps, by first applying a base layer of material (e.g., nickel) over the outer surface of the housing, and then applying a finish layer of material (e.g., chromium) over the base layer. The finish layer is polished to be highly thermally reflective.

The housing is further adapted to support a window in a region thereof for admitting radiation for the sensor, and, before the layer of reflective material is applied, an intermediate layer of material (e.g., copper) is applied over the housing in at least the window-supporting region, and the window is secured to the housing using the intermediate material layer. The intermediate layer may optionally be applied over the entire outer surface of the housing and buffed, thereby to promote adhesion between the base (i.e., nickel) layer and the housing.

Another general aspect of the invention is detecting, in a compartment, a flame that has a predetermined flicker rate range, by detecting radiation within the compartment with a sensor, determining whether the detected radiation has an intensity which exceeds a predetermined threshold intensity, determining whether the detected radiation that exceeds the threshold has a flicker rate that is within the predetermined range, determining whether a predetermined number of flickers that occur at a rate within the range have been detected within a variable time interval, and, if so, indicating that a flame is present within said compartment, the variable time interval starting upon detection of an initial flicker and ending after a predetermined delay unless a subsequent flicker is detected during said delay, a subsequent flicker detected during said delay extending the variable time interval for a predetermined time period such as that of the predetermined delay.

Preferred embodiments include the following features.

Signal events are produced whenever the detected radiation exceeds the threshold intensity, and a discriminator responds to the signal events by producing output pulses at a rate no higher than a selected flicker rate (e.g., 4 Hz.) in the range (e.g., between 3 Hz. and 15 Hz.). An enable signal is produced in response to an initial signal event and maintained as long as successive signal events are produced at time intervals not exceeding the predetermined delay. The output pulses from the discriminator are counted during enable signal, and counting is reset in the absence of the enable signal.

The presence of a flame in the compartment is indicated if a predetermined number of discriminator output pulses have been counted. The predetermined number of flickers is between two and eight, and preferably is five. The predetermined delay is between one second and ten seconds and is preferably 2.5 seconds.

A DC bias level is applied to the sensor to cause the sensor to produce output signals that are referenced to the bias level The sensor output signals are amplified, and the DC bias level is removed before the threshold comparison is made. The sensor is sensitive to infrared radiation and includes a spectral filter, for passing only radiation within a predetermined wavelength range of the flame. The predetermined wavelength range preferably is between 4 microns and 5 microns, and most preferably is 4.3 microns. The sensor is preferably a thermopile device that includes, e.g., at least one bismuth-antimony junction. Alternatively, sensor can be a pyroelectric or photoresistive device.

Other features and advantages of the invention will be apparent from the following detailed description, and from the claims.

DESCRIPTION OF THE PREFERRED EMBODIMENT

We first briefly describe the drawings.

STRUCTURE AND OPERATION

Figure 1:
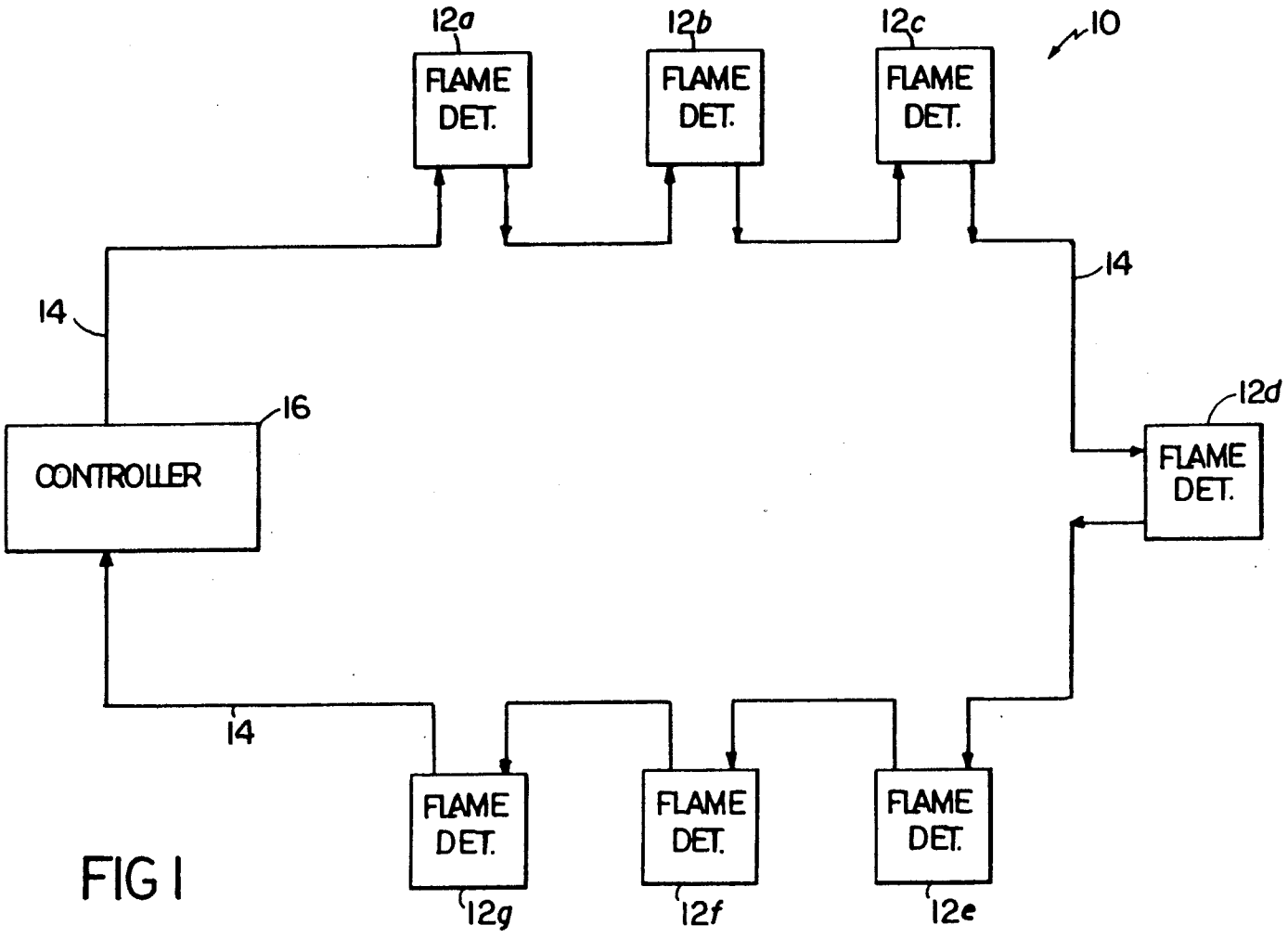
FIG. 1 is a block diagram of an aircraft flame detector system.

Referring to FIG. 1, aircraft flame detection system 10 includes a number of (e.g., seven) flame detectors **12*a*–12*g* disposed at various locations in the aircraft. For example, delectectors 12*a*–12*d* may be located throughout storage compartments, and detectors 12*e*–12*g* positioned in the nacelles of the engines of the aircraft. Detectors 12*a*–12*g* are connected in series (i.e., "daisy-chained") along cable 14, which originates and terminates at controller 16. Controller 16 supplies operating power and ground potential to detectors 12*a*–12*g* along cable 14. Detectors 12*a*–12*g* send signals to controller 16 on a common line of cable 14** to indicate the detection of a fire, as discussed in detail below.

Figure 2A:
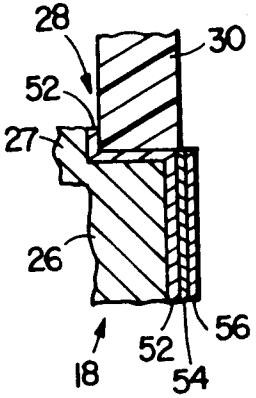
FIGS. 2A and 2B are enlarged partial sectional views of portions of FIG. 2 indicated A and B respectively.
Figure 2:
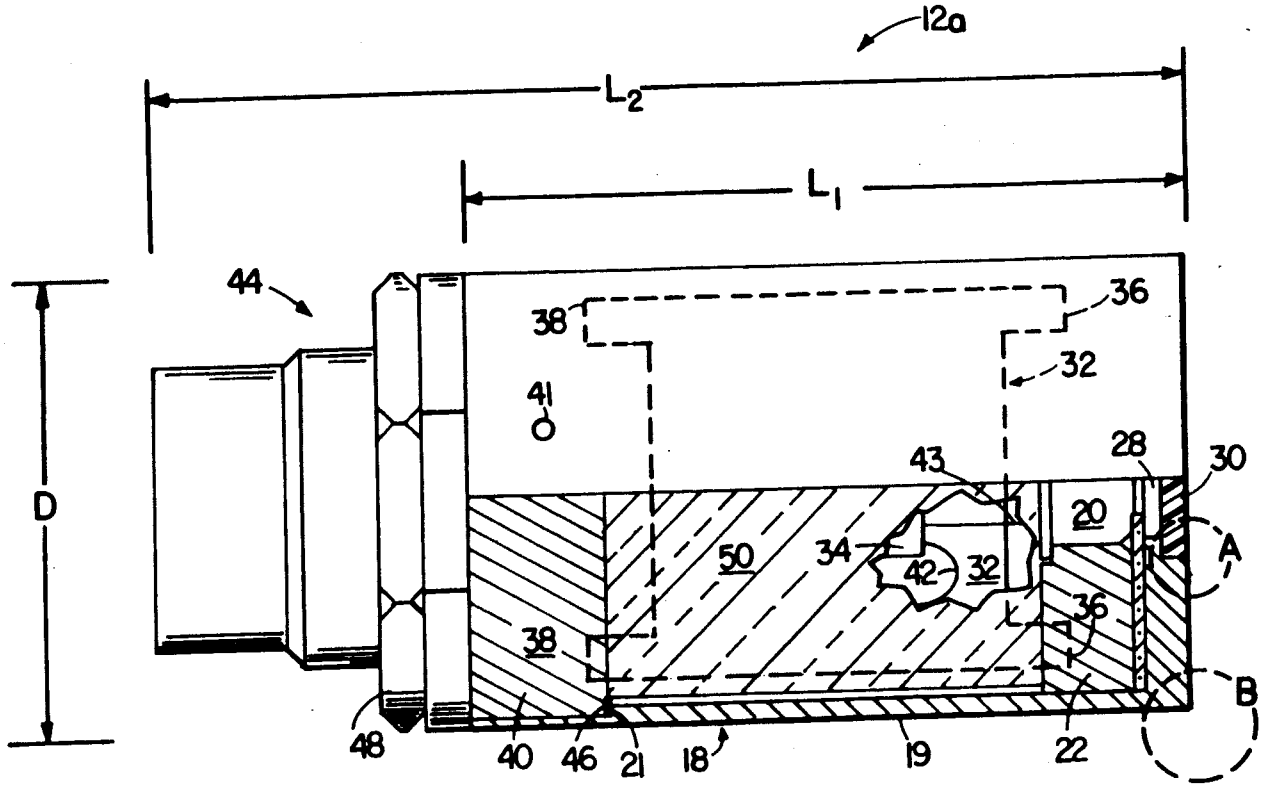
FIG. 2 is a partial cross-sectional diagram of an aircraft flame detector according to the invention for use in the system FIG. 1.
Figure 2B:
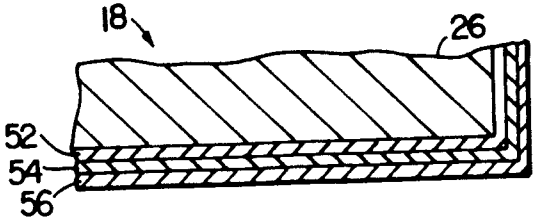

Referring to FIGS. 2, 2A and 2B, a partial cross-section of representative detector **12*a* of identically-constructed detectors 12*a*–12*g* is shown. Detector 12*a* includes a cylindrical aluminum housing 18, which is a hollow shell that has a length, $L_1$, of 2.0 inches and an outer diameter, D, of 1.29 inches. The side walls 19 of housing 18 are thin (e.g., approximately 0.045 inches thick), and step to a reduced thickness at an annular shelf 21 in the rear region of housing 18. Front wall 26 of housing is about 0.126 inches thick. The exterior surfaces of housing 18** are not anodyzed.

Housing 18 contains a radiation sensor 20, such as a thermopile sensor, disposed in a conventional TO-5 package. Sensor 20 is, for example, a Model #2M detector available from Dexter Research Center, Inc. of Dexter, Mich., and contains a 4.3 micron spectral filter (not shown). Thus, while sensor 20 is capable of detecting radiation having wavelengths between less than 0.1 microns and greater than 50 microns, the spectral filter sharply limits sensor 20 to respond only to energy having wavelengths of substantially 4.3 microns, the characteristic wavelength of radiation emitted by burning hydrocarbons. This substantially reduces the possibility of false alarms caused by the detection of, e.g., sunlight and lightning. Sensor 20 includes multiple antimony-bismuth junctions (e.g., 24 reference junctions, and 24 signal junctions that are exposed to radiation admitted through the spectral filter). Sensor 20 is mounted in a thermally-insulating bushing 22 which is held in place within housing 18 in a manner described in detail below. A high-dielectric insulator 24 (e.g., a dielectric paper washer) is disposed between bushing 22 and the front wall 26 to prevent sensor 20 from arcing to housing 18.

An opening 28 is disposed in front wall 26 (and insulator 24) to admit radiation for detection by sensor 20. A window 30 (made from, e.g., sapphire) is mounted within opening 28 in a manner described in detail below and serves to protect sensor 20 from heat and other environmental conditions which might damage or impair the operation of thermopile sensor 20.

A circuit card 32 on which the electronics of detector **12*a* (represented generally by reference numeral 34) are disposed is mounted within housing 18 by a pair of tabs 36 which engage bushing 22 and a pair of tabs 38 which engage a second bushing 40. Bushing 40 also threadably receives connector 44. When inserted in housing 18 in a manner described in detail below, bushing 40 engages annular shelf 21 and is secured to housing 18 by, e.g., three self-threading screws 41 which extend through wall 18 and into bushing 40. A gasket 46 seals the seam between bushing 40 and shelf 21**.

Electronic circuitry 34 makes connections with other devices on circuit card 32 with electrically conductive traces 42 formed on circuit card 32, and connections are also made to the leads 43 of thermopile sensor 20 and to the pins (not shown) of connector 44. Connector 44 is a commercially available receptable (e.g., a nickel-plated M83723/74R1212N receptacle) which connects to cable 14 (FIG. 1) for providing power, ground, and the common signal line to circuit card 32. Connector 44 includes a "flat" (not shown) for aligning connector 44 within an opening in, e.g., a wall for mounting detector **12*a* in the aircraft. Nut 48 and an O-ring washer (not shown) secures detector 12*a* to the wall. The overall length, $L_2$, of detector 12*a* is 2.9 inches, and thus detector 12*a*** is sufficiently compact to fit into small spaces in aircraft storage compartments or engine nacelles.

As discussed, it is highly desirable that detectors **12*a*–12*g* be sufficiently heat resistant so as to remain operational when exposed to extreme temperatures, such as those encountered when the detectors are immersed in flame for a short time. One military specification requires that aircraft flame detectors remain operational when exposed to 2000° F. temperature for 60 seconds. However, to be usable in the often narrow spaces of an aircraft engine nacelle or storage compartment, detectors 12*a*–12*g*** must be compact in size (i.e., in diameter as well as length).

Thus, in accordance with the invention, housing 18 is provided with a highly polished outer surface to reflect a substantial amount of incident (i.e., ambient) heat, and housing 18 is filled with a highly thermally insulating material 50 that encases circuit card 32 to block a substantial amount of that heat which may penetrate highly polished housing 18 from reaching (and possibly damaging) electronic circuitry 34. That is, detectors **12*a*–12*g* provide two levels of thermal protection for the components within housing 18: substantial reflection of incident heat by the outer surfaces of housing 18 and, with insulating material 50, substantial absorption of thermal energy that may penetrate housing 18** to impede such heat from reaching the components.

Housing 18 is provided with a highly polished outer surface by plating or coating the outer surfaces of housing 18 with a thin layer of chrome and then polishing the chrome to a high surface finish. However, before this is done, a layer 52 of copper flashing, having a thickness of 0.0003 inches ± 0.0001 inches, is applied over the outer surfaces of housing 18. The front wall 26 of housing 18 includes a shelf 27 that extends slightly into opening 28 for supporting sapphire window 30. Sapphire window 30, the edges of which are brazed with a thin layer of metal, such as silver palladium (not shown), is installed on shelf 27 and soldered in place within opening 28. Copper flashing layer 52 promotes a secure bond between the brazed edges of window 30 and housing 18. The solder is selected to withstand exposure to the high temperatures specified above, and is, for example, part no. Xersin 2000 manufactured by Multi Core Solders of Wesbury, N.Y.

After sapphire window 30 has been soldered in place, copper layer 52 is buffed and housing 18 is plated with thin (i.e., 0.0011 inches±0.0001 inches thick) layer 54 of nickel. Then, a very thin layer 56 of chromium (i.e., 0.0002 inches±0.00005 inches thick) is applied (i.e., plated) over base nickel layer 54. Copper layer 52 promotes adhesion between nickel layer 54 and aluminum housing 18, and nickel layer 54 aids in the adhesion of the chromium layer 56 to housing 18. Nickel layer 54 also provides corrosion protection. Chromium layer 56 is then polished (e.g., by electropolishing) to a bright finish. Note that the plated nickel and chromium does not adhere to surfaces of sapphire window 30 other than its silver palladium-brazed edges.

Portions of housing 18 (i.e., the corner of front wall 26 and the region of wall 26 around opening 28 and shelf 27) are shown greatly magnified in FIG. 2 so that copper layer 52, nickel base layer 54, and outer chrome layer 56 can be seen. Obviously, the thicknesses of layers 52, 54, 56 are infinitesimal when compared with the nominal outer diameter D (1.29 inches) of housing 18. In fact, the outer diameter of housing 18 is increased by less than 0.3 percent by the combined maximum thicknesses of layers 52, 54, 56. Thus, a detector **12*a* with highly polished housing 18** can be placed in substantially any location as a detector having a non-polished housing of outer diameter D.

Sensor 20 and fully-assembled circuit card 32 are inserted into bushing 22 outside of housing 18, and the electrical connections between sensor 20 and circuit card 32 are made by soldering. Then, the assembled bushing 40 and connector 44 are inserted onto circuit card tabs 38 and the electrical connections to connector 44 are made. These components are placed together in one half of a two-part mold for subsequent encasement by thermally insulating material 50. The mold cavity is cylindrical in shape and is slightly smaller in diameter than the inside diameter of housing 18.

Insulating material 50 is, for example, a two-part silicone rubber-based potting compound (such as part number TBS-758, manufactured by the Silicone Products Department of the General Electric Co., Waterford, N.Y.). Prior to injecting potting compound 50 into the mold, the silicone rubber base is thoroughly mixed with 10 percent by weight of the curing agent. The mold is then closed and sealed, and the mixed potting compound is injected under low pressure (i.e., by gun or by hand) through, e.g., a pair of injection holes in the mold. The mold also includes a pair of bleed holes for aiding in determining when the mold has been filled. After the mixture has been completely injected into the mold, the potting compound is cured by heating the mold at 160° F. for three hours.

After the mold has cooled, the integral assembly of sensor 20, bushing 22, circuit card 34 encased in thermally insulating material 50, bushing 40, and connector 44 is removed from the mold and inserted into housing 18 along with insulator 24. The integral assembly is secured within housing 18 by screws 41.

Thermally insulating material 50 not only protects circuit card 32 and electrical components 34 from mechanical effects such as shock and vibration, it also blocks heat which may penetrate highly polished housing 18, and thus provides an additional thermal barrier for circuit card 32 and components 34. The combined thermal protection provided by highly polished housing 18 and thermally insulating material 50 allows detector **12*a* to be exposed to temperatures of 2000° F. or higher for periods of time (e.g., 60 seconds) while maintaining the temperature to which circuit card 32 and components 34 are exposed significantly lower. For example, after detector has been heated to 2000° F. for 60 seconds, the temperature at the center of card 32 may rise to approximately 400° F. for 5 to 10 minutes, and the temperature near the edges of card 32 (where a lesser thickness of insulating material 50 is present) may rise to approximately 600° F. for 5 to 10 minutes. As a result, components 34 and circuit card 32** can continue to operate, supplying the crew of the aircraft with vital information about the state of the fire.

Because highly polished housing 18 and insulating material cannot shield the interior of housing 18 from temperature increases caused by the exposure of detector 12a to flames, circuit card 32 and components 34 are selected to withstand short-term temperatures of e.g., 400° F. For example, circuit card 32 is 0.062 inch-thick, copper clad G-30 polyimide. Also, high temperature surface mount solder cream (e.g., part no. 6-SN10-200-C, manufactured by ESP of East Providence, R.I.) is used to make electrical connections and mount components on circuit card 32. Additionally, hook-up wires between circuit card 32 and connector 44 and sensor 20 are selected to withstand the high temperatures experienced within housing 18, and are, for example, part no. XE22-1934 manufactured by Harbour Industries of Shelbourne, Vt. Also, electrical components 34 are mounted near the center of circuit card 32, rather than at the edges of the card, to receive maximum thermal protection from insulating material 50.

Referring again to FIG. 1, as discussed, detectors 12a–12g are connected serially along cable 14 and are monitored by controller 12. In operation, each detector 12a–12g detects and analyzes electromagnetic radiation generated by activity within the area of aircraft (e.g., an engine nacelle or storage compartment) in which the detector is located. The electronic circuitry 34 (FIG. 2) in each detector 12a–12g determines whether activity that has been detected by its sensor 20 is a flame generated by burning hydrocarbons and also determines if the flame is of a predetermined intensity, flicker rate, and duration. If so, an alarm condition is deemed to exist, and electronic circuitry 34 sends an alarm signal to controller 16 via cable 14.

Electronic circuitry 34 analyzes signals produced by sensor 20 to determine whether a hydrocarbon flame does indeed exist based on known characteristics of flames generated by burning hydrocarbons, and thus differentiates these flames from other activity (such as sunlight, lightning, sparking or arcing, and fluorescent lighting). One of these characteristics is the 4.3 micron wavelength radiation generated by hydrocarbon flames. The spectral filter on sensor 20 permits sensor 20 to detect only radiation having this profile, thereby reducing the possibility of false alarms.

Burning hydrocarbons also produce flames that "flicker" at a rate within a predictable range, such as between 3 and 15 flickers per second (i.e., between 3 and 15 Hz).

Also, to avoid indicating an alarm condition for hydrocarbon flashes which meet the requisite flicker rate but which do not result in a continuing flame, circuitry 34 determines whether the detected activity exists for a predetermined length of time (e.g., for more than one second) before indicating an alarm condition. This avoids unnecessary release of chemical suppresant or an unnecessary landing and evacuation of the aircraft.

Figure 3:
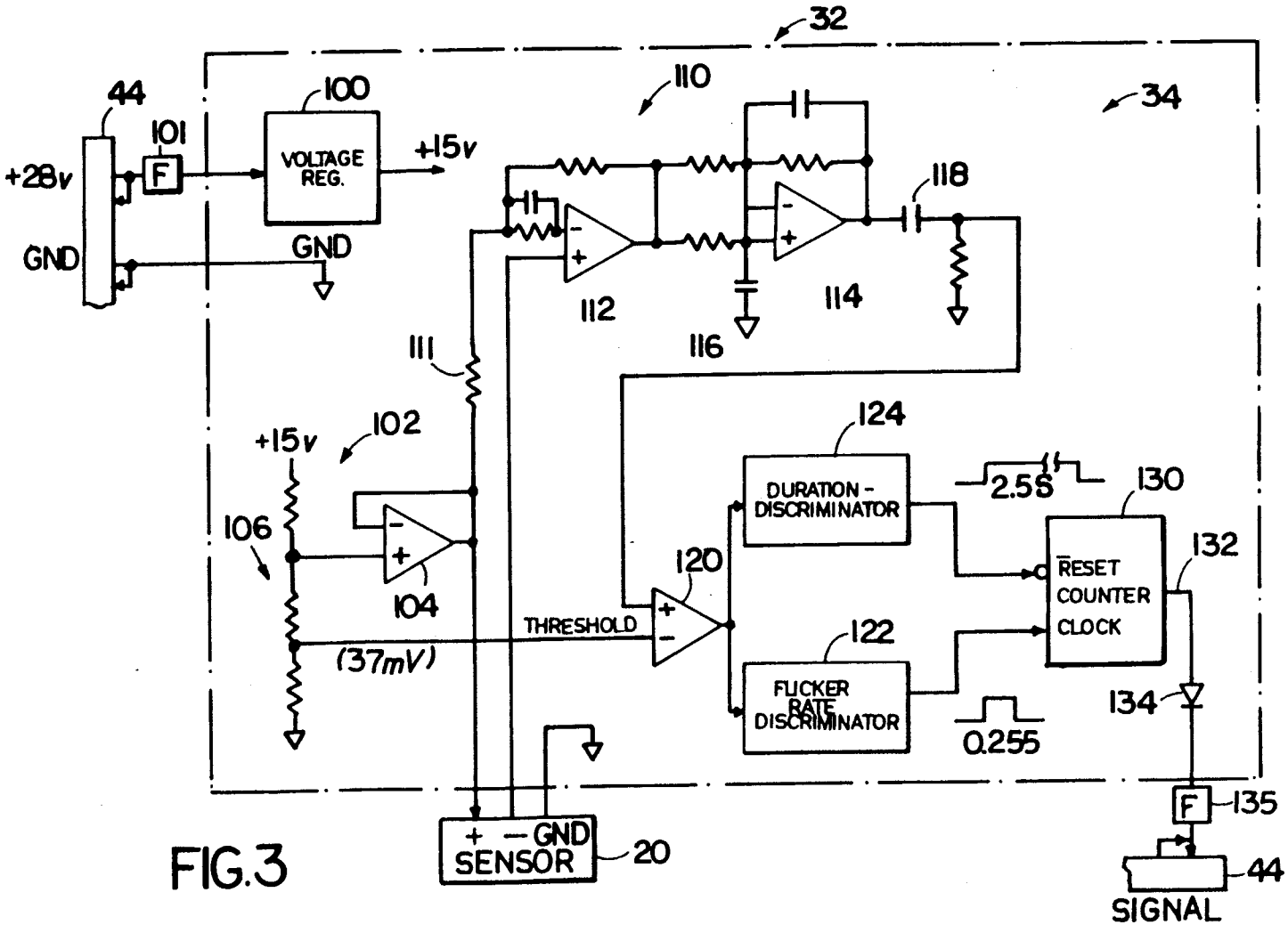
FIG. 3 is a schematic and block diagram of the electronic circuitry of the aircraft flame detector of FIG. 2.

Referring to FIG. 3, the electronic circuitry 34 (FIG. 2) of detectors 12a–12g includes a voltage regulator 100 for receiving operating power (e.g., +28 VDC) from the aircraft via a connector 44 (FIG. 2) and an RFI filter 101 (located within housing 18) and converting it to +15 VDC operating potential for the remainder of the circuitry. Connector 44 also provides a system-wide ground potential for circuitry 34 from cable 14.

As discussed, sensor 20 is a thermopile (i.e., multiple thermocouple) detector, which is a DC device that is referenced to the common ground potential. The signal produced by sensor 20 (e.g., at its (−) terminal) is very small, (e.g., on the order of tens of microvolts), even in the presence of intense radiation. Bias voltage of approximately 0.5 VDC is applied to an input (i.e., the (+) terminal) of sensor 20 by bias circuitry 102 to cause the output signal from sensor 20 to be referenced to this level rather than to ground potential. This facilitates amplification and subsequent detection of the output of sensor 20. Bias circuitry 102 includes a unity gain amplifier 104 having a 0.5 volt input provided by voltage divider 106. Amplifier 104 provides bias circuitry 102 with a low-impedance output.

Amplifier 110 is a two stage amplifier, the first stage 112 of which receives the output of bias circuitry 102 (via resistor 111) and the output of sensor 20. Amplifier 112 has a high gain (e.g., 100), and its output is further amplified by second stage 114, the gain of which is somewhat less than that of stage 112 (e.g., 15). A low-pass R-C filter 16 between stages 112, 114 removes frequency components that exceed 15 Hz (i.e., the maximum flicker rate for hydrocarbon flames) from the signal applied to amplifier stage 114, and thus aids in discriminating against noise caused by, e.g., fluorescent lighting, lightning, and sparking to reduce the incidence of false alarms. The DC component on the output of amplifier 114 is removed by blocking capacitor 118, thereby causing a signal referenced to ground potential to be applied to the (+) input of comparator 120.

Comparator 120 determines whether the output of sensor 0 is of sufficient intensity so as to be an indication that a flame (rather than, e.g., a spark) is present by comparing the signal provided by amplifier 110 with a threshold level from voltage divider 106. Each time a signal exceeds the threshold (e.g., 37 mVDC), comparator 120 produces a pulse (i.e., a "signal event") for the duration of time that the threshold is exceeded.

Pulses produced by comparator 120 are applied to a flicker rate discriminator 122, and to a duration discriminator 124.

Figure 4:
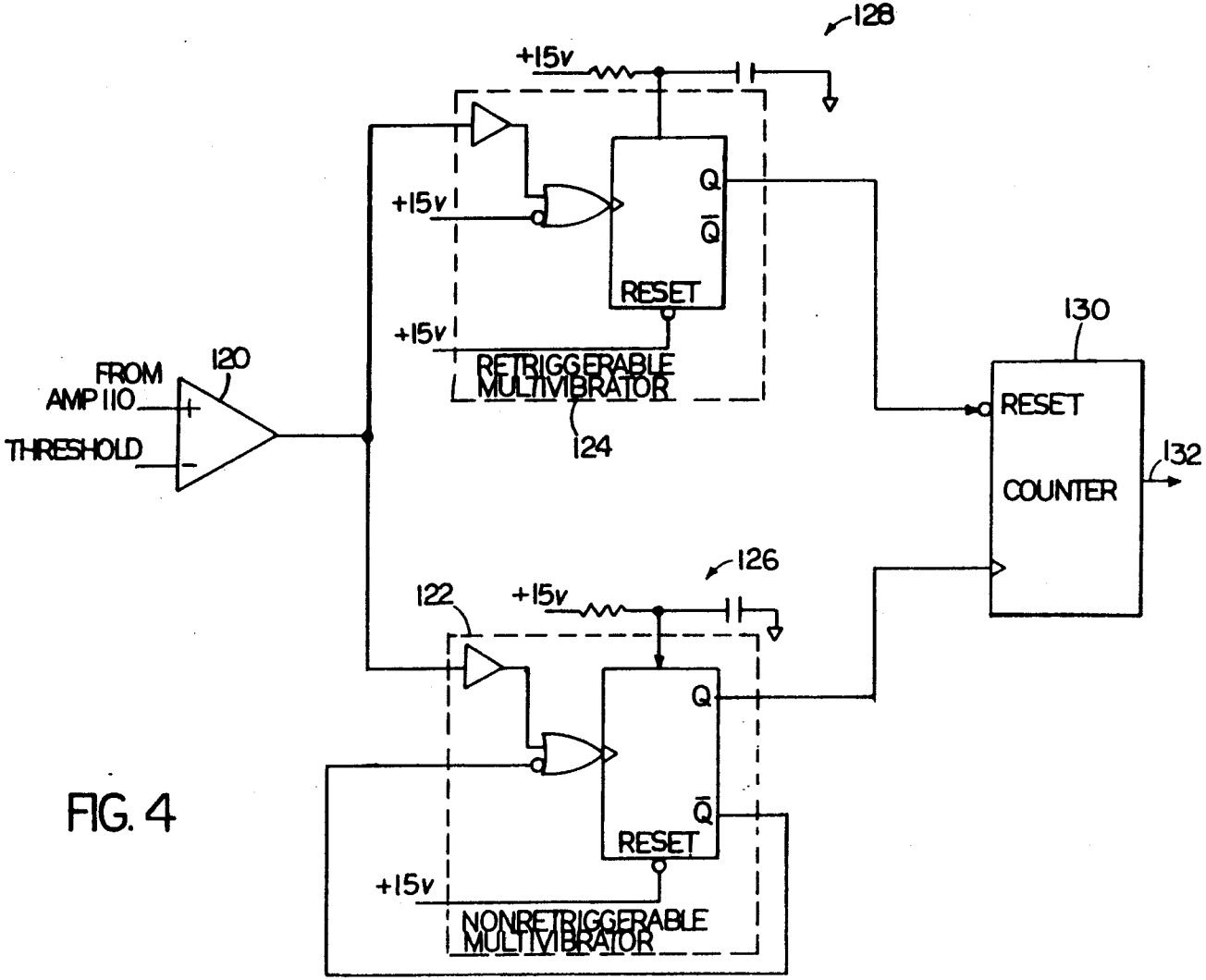
FIG. 4 is a schematic diagram of some of the components of the circuitry of FIG. 3.

Referring also to FIG. 4, discriminators 122, 124 are, e.g., Motorola MC14538B multivibrators. Flicker rate multivibrator 122 is connected as a nonretriggerable device, but duration discriminator multivibrator 124 is connected to be retriggerable. The R-C timing network 126 of multivibrator 122 is selected to produce an output pulse of 0.25 seconds duration in response to an applied pulse from comparator 120, while the time constant of R-C network 128 of multivibrator 124 is 2.5 seconds.

The output of duration discriminator multivibrator 124 controls the operation of a counter 130. The clock for counter 130 (e.g., a Motorola MC 14022B) is provided by the 0.25 second-wide output pulses from flicker rate discriminator multivibrator 122. Counter 130 is enabled to count during the existence of an output pulse from multivibrator 124, and is reset to a count of zero whenever such pulse terminates. Counter 130 is selected to produce a logic "1" output signal on line 132 whenever a count of, e.g., 5 is reached, that is, when counter 130 has counted five flickers as indicated by flicker rate discriminator 122. (Alternatively, counter 130 can be programmed to count to any value between, e.g., 1 and 8.)

In operation, each time a pulse is produced by comparator 120, it is simultaneously applied to multivibrators 122, 124. Multivibrator 122 responds by producing a 0.25 second-duration output pulse. Because multivibrator 122 is nonretriggerable, it will ignore all pulses from comparator 120 during the existence of the 0.25 second pulse. Thus, pulses from comparator 120 (corresponding to flickers detected by sensor 20) that occur at a frequency of greater than about 4 Hz are ignored by multivibrator 122. To put it another way, nonretriggerable multivibrator 122 applies clock pulses at a maximum rate of about 4 Hz to counter 130, even if the pulses from comparator 120 occur at a higher rate (e.g., up to 15 Hz).

The initial pulse from comparator 120 also triggers multivibrator 124, which responds by sending a logic "1" pulse of at least 2.5 seconds in duration to enable counter 130 to count subsequent pulses from multivibrator 122. Because multivibrator 124 is retriggerable, each subsequent pulse from comparator 120 which occurs during this 2.5 second period causes the logic "1" output pulse produced by multivibrator to be extended in duration for 2.5 seconds.

Thus, counter 130 counts the 0.25 second duration clock pulses from multivibrator 122 for the duration of the logic "1" enable pulse from multivibrator 124. If 5 such pulses are counted, a flame having the desired flicker rate is deemed to be present for the proper duration, and the output 132 of counter 130 is asserted as an alarm signal. Note that, because the maximum rate of the clock pulses is about 4 Hz, the time taken by the counter 130 to reach a count of 5 when the detected flicker rate is 15 Hz is substantially the same as the time taken to reach that count for a 4 Hz flicker rate. This further avoids false alarms caused by flashes of 15 Hz flickers that do not become a flame.

Referring again to FIGS. 1 and 3, the alarm signal forward biases diode 134 and is coupled through RFI filter 135 and via connector 44 (FIG. 2) and cable 14 to controller 16. The diodes 134 in the other detectors present high impedance loads to the alarm signal. Controller 16 responds to the alarm signal by notifying the crew of the fire (such as by illuminating a warning light or sounding an alarm). A suppressant may then be released to extinguish the fire. The high tolerance of detectors **12*a*–12*g*** to extreme temperatures permits the detectors to continue to operate for a time even when exposed to flame, thereby providing the crew with continuous information about the fire and their success or failure in extinguishing it. As a result, the crew can make an informed decision as to whether to take such additional steps as making an immediate landing and evacuating the aircraft.

Referring again to FIG. 4, it should be noted that duration discriminator multivibrator 124 does not provide counter 130 with a fixed duration within which five 0.25 second duration pulses must be counted. Rather, the interval during which counter 130 is enabled to count is extended by 2.5 seconds each time that multivibrator 124 receives a pulse from comparator 120.

If counter 130 has a count of less than five when the enable pulse from multivibrator 124 terminates (i.e., becomes a logic "0"), counter 130 is reset and must begin counting from zero the next time that pulses are presented from comparator 120.

As can be seen from FIG. 3, the continuity of cable 14 is broken if one of detectors **12*a*–12*g* is disconnected from the cable (by unplugging connector 44**).

It is also noted that amplifiers 104, 112, and 116 and comparator 120 are implemented on a single integrated circuit (e.g., a National Semiconductor LM124FKB), as are multivibrators 122, 124.

Other embodiments are within the following claims. For example, in the arrangement shown in FIG. 4, the pulse from comparator 120 that initially triggers multivibrators 122, 124 is not counted by counter 130 (due to the prior reset condition of counter 130). This initial pulse can be counted by inserting a short delay between, e.g., multivibrator 122 and the clock input of counter 130. Also, the duration of the pulses produced by multivibrator 122 can be changed to, e.g., allow higher frequency clock pulses to be applied to counter 130. The retriggerable pulse width of multivibrator 124 may also be adjusted. Further, counter 130 can be arranged to count fewer or more than five flickers before asserting the alarm signal.

We claim:

1. A flame detector comprising a single-wall housing containing a flame sensor and circuitry for processing signals produced by said sensor, said housing having a predetermined outer diameter, and a thin, highly thermally reflective coating adhered to an outer surface of said housing for shielding said sensor and said circuitry from high ambient temperatures, whereby said detector is operable at said high ambient temperatures while having an outer diameter that is substantially the same as said predetermined diameter, said detector further comprising a thermally insulating material disposed within said housing and surrounding said circuitry and substantially filling all voids between said housing and circuitry to further protect said circuitry from said high ambient temperatures.

2. The detector of claim 1 wherein the thickness of said coating is such as to increase said predetermined diameter by less than 0.3 percent.

3. The detector of claim 1 wherein said highly reflective coating comprises polished chromium.

4. The detector of claim 1 wherein a region of said housing supports a window for admitting radiation for detection by said flame sensor, said coating exposing said window.

5. The detector of claim 4 further comprising an intermediate coating disposed between said outer surface and said highly reflective coating in said region of said window to aid in adhering said window to said housing.

6. The detector of claim 5 wherein said housing comprises aluminum and said intermediate coating comprises copper.

7. The detector of claim 5 wherein said window comprises sapphire.

8. The detector of claim 1 wherein said high ambient temperature is 2000° F.

9. The detector of claim 1 wherein said circuitry is disposed on a circuit card.

10. The detector of claim 9 wherein electrical connections between components of said circuitry on said circuit card are made with high-temperature-resistant solder.

11. The detector of claim 9 wherein said circuit card comprises a high-temperature-resistant material.

12. The detector of claim 11 wherein said material is G-30 material.

13. A flame detector comprising a single-wall housing containing a flame sensor and circuitry for processing signals produced by said sensor, said housing having a predetermined outer diameter, and a thin, highly thermally reflective coating adhered to an outer surface of said housing for shielding said sensor and said circuitry from high ambient temperatures.

whereby said detector is operable at said high ambient temperatures while having an outer diameter that is substantially the same as said predetermined diameter, wherein said detector detects flames having a predetermined flicker rate range, and said sensor detects radiation within said compartment, said circuitry for processing signals comprising (a) a threshold detector for determining whether said detected radiation has an intensity which exceeds a predetermined threshold intensity, (b) a discriminator for determining whether said radiation that exceeds said threshold has a flicker rate that is within said range, and (c) decision circuitry for determining whether a predetermined number of flickers that occur at a rate within said range have been detected within a variable time interval, and, if so, indicating that a flame is present within said compartment, said interval starting upon detection of an initial flicker and ending after a predetermined delay unless a subsequent flicker is detected during said delay, a detected subsequent flicker extending the variable time interval for a predetermined time period.

14. The detector of claim 13 further comprising a thermally insulating material disposed within said housing and surrounding said circuitry and substantially filling all voids between said housing and circuitry to further protect said circuitry from said high ambient temperatures.

15. A method of fabricating a flame detector having a single-wall housing that contains a flame sensor and circuitry for processing signals produced by said sensor, said housing having a predetermined outer diameter, comprising applying a thin layer of material to an outer surface said housing, and making said layer highly thermally reflective to shield said sensor and said circuitry from high ambient temperatures, whereby said detector is operable at said high ambient temperatures while having an outer diameter that is substantially the same as said predetermined outer diameter, said method further comprising installing said sensor and said circuitry in said housing with a thermally insulating material in said housing to surround said circuitry and substantially fill all voids between said housing and circuitry and to further protect said circuitry from said high ambient temperatures.

16. The method of claim 15 wherein said applying step comprises applying a base layer of material over said outer surface, and then applying a finish layer of material over said base layer.

17. The method of claim 16 wherein said step of making said layer highly thermally reflective comprises polishing said finish layer of material.

18. The method of claim 16 wherein said base layer of material comprises nickel.

19. The method of claim 16 wherein said finish layer of material comprises chromium.

20. The method of claim 15 wherein said housing is further adapted to support a window in a region of said housing for admitting radiation for said sensor, and said method further comprises, before said applying step, applying an intermediate layer of material over said housing in at least said region, securing said window to said housing using said intermediate material layer.

21. The method of claim 20 further comprising applying said intermediate layer of material over other regions of said housing.

22. The method of claim 21 further comprising buffing said intermediate layer of material.

23. The method of claim 21 wherein said intermediate material layer comprises copper.

24. Apparatus for detecting a flame in a compartment, the flame having a predetermined flicker rate range, comprising a sensor for detecting radiation within said compartment, a threshold detector for determining whether said detected radiation has an intensity which exceeds a predetermined threshold intensity, a discriminator for determining whether said radiation that exceeds said threshold has a flicker rate that is within said range, and decision circuitry for determining whether a predetermined number of flickers that occur at a rate within said range have been detected within a variable time interval, and, if so, indicating that a flame is present within said compartment, said interval starting upon detection of an initial flicker and ending after a predetermined delay unless a subsequent flicker is detected during said delay, a detected subsequent flicker extending the variable time interval for a predetermined time period.

25. The apparatus of claim 24 wherein said threshold detector comprises a comparator that produces signal events whenever said detected radiation exceeds said threshold intensity, said discriminator responding to said signal events by producing output pulses at a rate no higher than a selected flicker rate in said range.

26. The apparatus of claim 25 wherein said decision circuitry further comprises a counter for counting said output pulses from said discriminator whenever an enable signal is maintained, said counter being reset in the absence of said enable signal.

27. The apparatus of claim 26 wherein said decision circuitry responds to said signal events by producing said enable signal in response to an initial signal event and maintaining said enable signal as long as successive ones of said signal events are produced at time intervals not exceeding said predetermined delay.

28. The apparatus of claim 27 wherein said decision circuitry further comprises circuitry for indicating the presence of a flame in said compartment if said counter has counted a predetermined number of said discriminator output pulses.

29. The apparatus of claim 25 wherein said predetermined flicker rate range is between 3 Hz and 15 Hz.

30. The apparatus of claim 29 wherein said selected flicker rate is approximately 4 Hz.

31. The apparatus of claim 24 wherein said predetermined number of flickers is between 2 and 8.

32. The apparatus of claim 31 wherein said predetermined number of flickers is 5.

33. The apparatus of claim 24 wherein said predetermined delay is between one second and ten seconds.

34. The apparatus of claim 33 wherein said predetermined delay is 2.5 seconds.

35. The apparatus of claim 24 further comprising circuitry for applying a DC bias level to said sensor to cause said sensor to produce output signals reference to said bias level, circuitry for amplifying said output signals and for removing the DC component of said amplified output signals, and means for applying said amplified output signals without the DC component to said threshold detector 36. The apparatus of claim 24 wherein said sensor is sensitive to infrared radiation and further comprises a spectral filter for passing only radiation within a predetermined wavelength range of said flame.

37. The apparatus of claim 36 wherein said predetermined wavelength range is between 4 microns and 5 microns.

38. The apparatus of claim 36 wherein said predetermined wavelength range is 4.3 microns.

39. The apparatus of claim 24 wherein said sensor comprises a thermopile.

40. The apparatus of claim 39 wherein said thermopile includes at least one bismuth-antimony junction.

41. The apparatus of claim 24 wherein said sensor comprises a pyroelectric device.

42. The apparatus of claim 24 wherein said sensor comprises a photoresistive device.

* * * * *